United States Patent [19]

Roberts

[11] Patent Number: 4,506,648

[45] Date of Patent: Mar. 26, 1985

[54] CONTROLLED DISPLACEMENT SUPERCHARGER

[75] Inventor: Richard W. Roberts, Lombard, Ill.

[73] Assignee: Borg-Warner Corporation, Chicago, Ill.

[21] Appl. No.: 438,551

[22] Filed: Nov. 1, 1982

[51] Int. Cl.[3] ..... F02B 33/00; F02D 23/00; F04B 1/26

[52] U.S. Cl. ..... 123/564; 417/222; 92/12.2

[58] Field of Search ..... 123/564; 92/12.2; 417/218, 222, 270

[56] References Cited

U.S. PATENT DOCUMENTS

| | | | |
|---|---|---|---|
| 3,062,020 | 11/1962 | Heidorn | 417/222 |
| 4,145,163 | 3/1979 | Fogelberg | 417/222 |
| 4,178,135 | 12/1979 | Roberts | 417/222 |
| 4,294,139 | 10/1981 | Bex | 92/122 |

*Primary Examiner*—William L. Freeh

*Attorney, Agent, or Firm*—Florian S. Gregorczyk

[57] ABSTRACT

An axial piston, controlled displacement, wobble plate supercharger and control circuit for use with an internal combustion engine. A means for providing all torque loading along the drive shaft of such a supercharger is taught herein.

14 Claims, 20 Drawing Figures

4
4
14
14
15
15

Fig. 11.
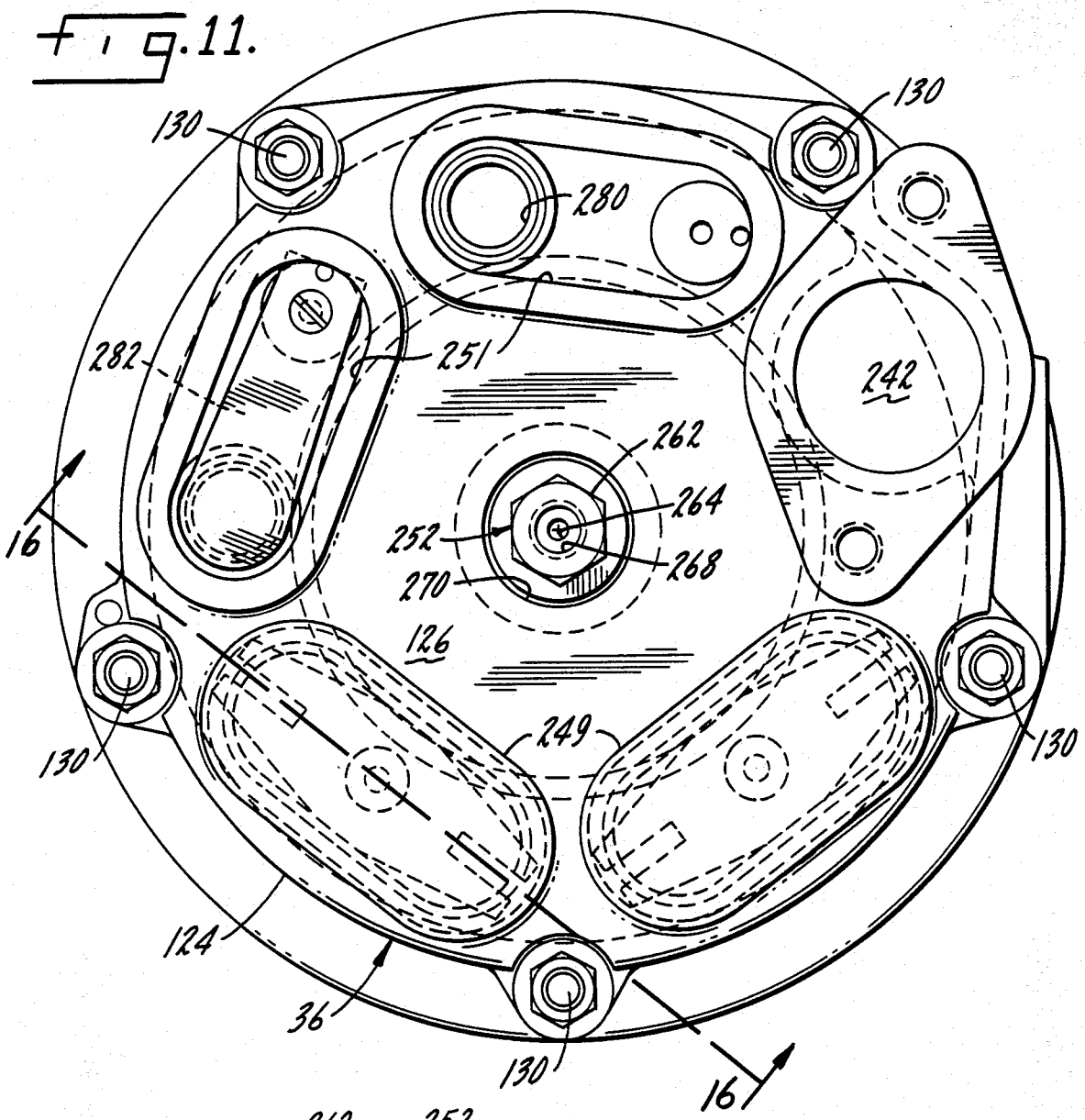
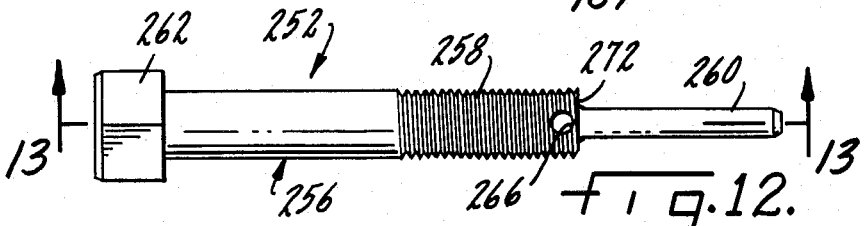
Fig. 12.
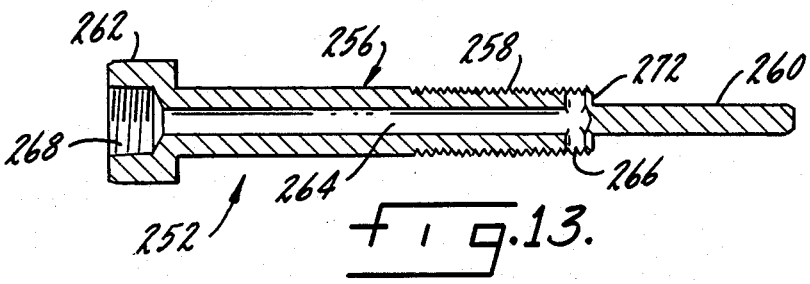
Fig. 13.

CONTROLLED DISPLACEMENT SUPERCHARGER

BACKGROUND OF THE INVENTION

Superchargers in general provide a means for introducing air for combustion into the cylinder of an internal combustion (i/c) engine at a pressure in excess of that attainable by natural aspiration. Superchargers may be broadly defined as an air pump or blower in the intake system of an internal combustion engine used to increase the weight of air charge and consequent power output from a given engine size. These are broad definitional descriptions of a supercharger action and its relation to an internal combustion engine. With regard to an internal combustion engine a supercharger is provided to increase boost pressure, especially in aircraft i/c engines. Such boost pressure obtained by supercharging implies a manifold pressure greater than the ambient at atmospheric pressure, (cf. McGraw-Hill Dictionary of Scientific and Technical Terms; McGraw-Hill, Inc., 1974, New York, N.Y. p. 180). Other such definitions refer to a volumetric increase in the air charge to an engine or compartment as from a blower or compressor.

Historically, such superchargers or blowers were provided on i/c engine aircraft to increase the engine horsepower at elevated altitudes to the noted horsepower at sea level, or such blowers were utilized on racing vehicles to increase speed. These superchargers have not found general acceptance in the automobile industry primarily for three reasons (a) cost, (b) added fuel consumption and (c) the increased power derived was not recognized as a need in view of the first two reasons. The current automotive trend toward smaller engines or diesel engines in the automotive industry has highlighted a need for added power at least under certain circumstances such as rapid acceleration during passing or while carrying heavier loads. The accomplishment of this added power requirement without increasing engine size or adversely affecting fuel economy or performance is being attained by means of fuel injection, turbocharging, or supercharging among other means. Although a horsepower gain of about one-third could be realized by utilizing superchargers or blowers the concomitant preignition problems from an increased air charge pressure and temperature required the use of higher octane, thus higher cost fuel. In a diesel engine the increased air content from the blower permits the engine to burn more fuel and thus produces a higher horsepower output without creating combustion problems. Such improvements allow decreased size and weight of diesel engines.

SUMMARY OF THE INVENTION

The present invention is directed to an improved supercharger (s/c) and control assembly for use with an internal combustion or diesel engine to provide added power. The structure particularly illustrates the use of a wobble plate drive means for a piston-type supercharger. Further, this unit is operable in response to an external actuation signal. This external signal could potentially be activated by a speed signal or other measured parameter. This external actuation signal could be electronic, such as from a solenoid valve responsive to a signal from a microprocessing unit, or a vacuum valve responsive to a change in manifold vacuum level. The response to an external signal by a control valve of the supercharger introduces a pressurized fluid to an actuating cylinder to drive an actuating piston which moves the wobble plate drive means into an operating mode. The s/c then compresses and elevates the pressure of the air-fuel mixture to the engine.

This supercharger provides increased power to an engine at a reasonable cost. The wobble plate structure is designed to avoid torque loading of the pivot linkage by providing all torque through the drive hub and shaft mechanism during the operating mode.

BRIEF DESCRIPTION OF THE DRAWING

In the several figures of the drawing, like reference numerals identify like components, and in the drawing:

FIG. 11 is a rear elevation view of the head assembly of FIG. 3 and with bypass valve and ports shown;

FIG. 12 is a longitudinal plan view of hollow bolt securing means of the head and valve assemblies;

FIG. 13 is a cross-sectional view of the bolt taken along line 13—13 of FIG. 12;

DETAILED DESCRIPTION OF THE EMBODIMENT

Figure 1:
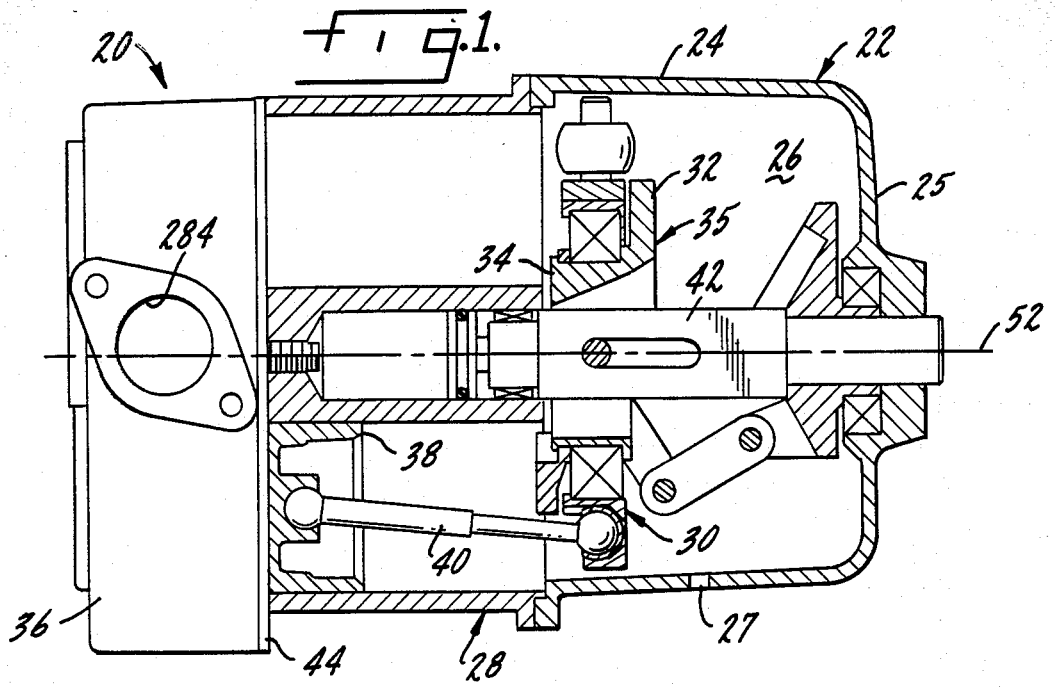
FIG. 1 is a diagrammatic cross-sectional view of the operating elements of the invention.
Figure 2:
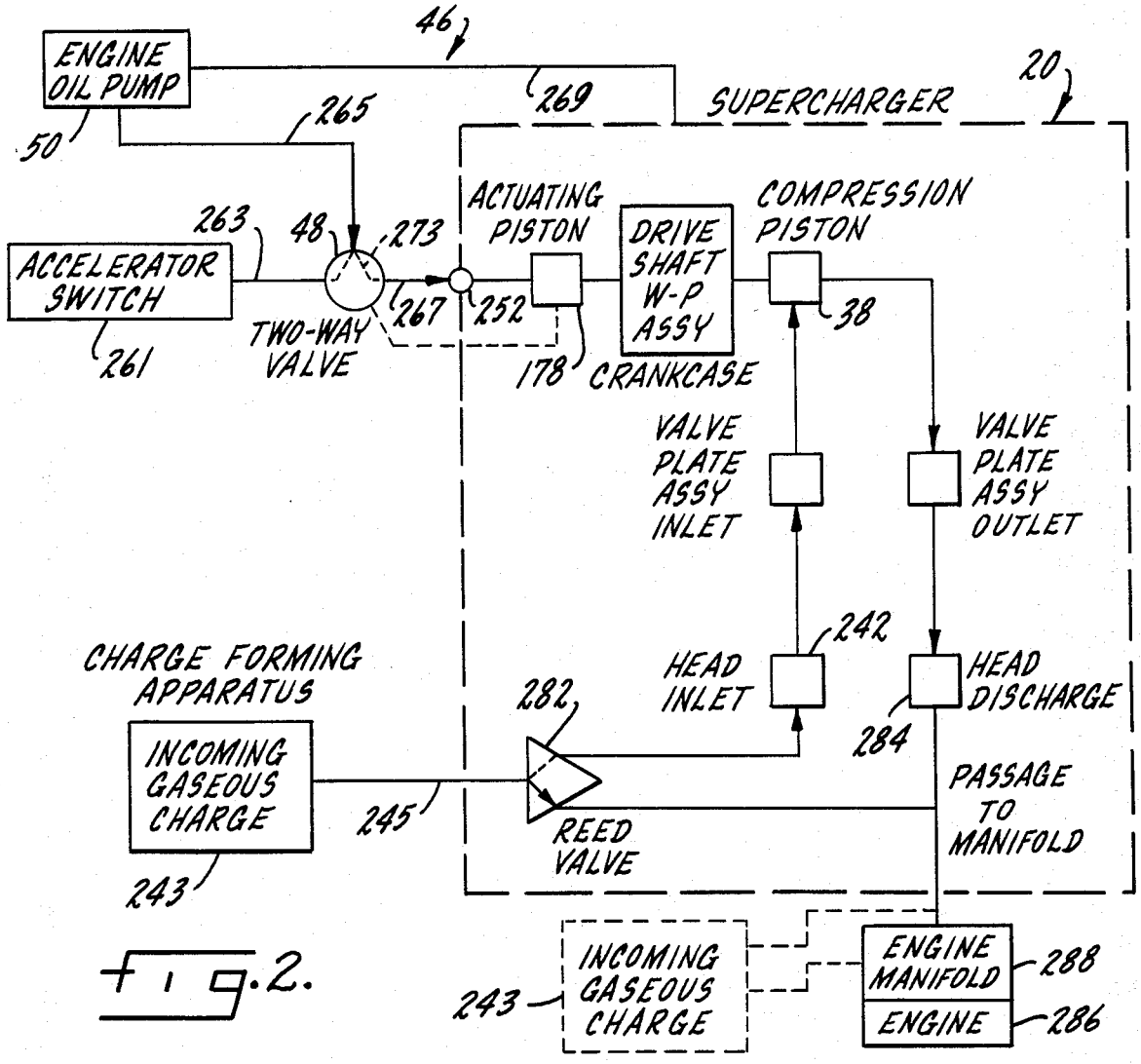
FIG. 2 is a block diagram of the control circuit of the supercharger in cooperation with an engine.
Figure 3:
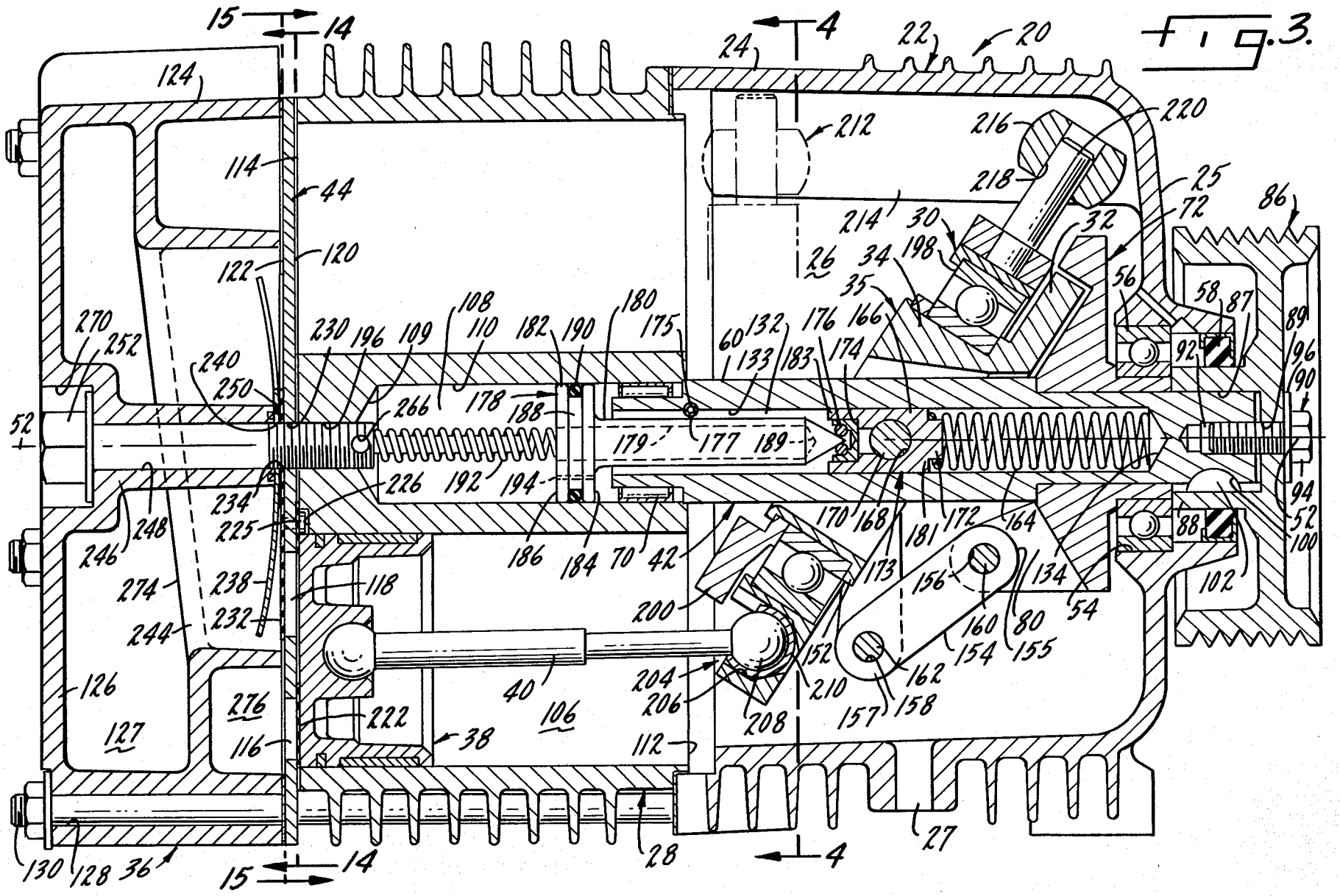
FIG. 3 is an axial view in cross-section along the longitudinal axis of a preferred embodiment of the invention.

A supercharger (hereinafter s/c) 20 is shown in FIGS. 1 and 3 as a plurality of subassemblies. FIG. 1 is a diagrammatic cross-section illustrating the relative structural arrangement wherein the mechanical or drive parts are disposed within a housing 22. Housing 22 is illustrated as a cylindrical cup-shape in cross-section and is provided with sidewalls 24, an endwall 25 at one end and open at the opposite end. Sidewalls 24 and endwall 25 define a crankcase 26 to receive the above-noted mechanical parts. The remaining subassemblies include a first means or cylinder block 28, a wobble-plate assembly 30, a drive assembly 35 comprising a drive hub 34 with a counterweight 32, a head assembly 36, a plurality of compression pistons 38 and associated connecting rods 40, a drive shaft 42 and a valve plate assembly 44. As illustrated in the block diagram of FIG. 2, the s/c 20 is operable with a control circuit 46 which includes a two-way vlave 48 to pass fluid under pressure from a fluid pressure means, noted as an oil pump 50. The elements of the s/c 20 and their spatial relationship to each other are shown diagrammatically in FIG. 1 and the same s/c 20 is illustrated in FIG. 3 in a detailed cross-sectional view of the preferred embodiment along its longitudinal axis 52.

FIG. 3 illustrates s/c 20 in a preferred embodiment along its longitudinal axis 52 with the subassemblies noted above. In the following description, the "front" of s/c unit 20 refers to the right-hand side of FIG. 3 and the "rear" refers to the left-hand side of FIG. 3. FIG. 3 shows housing 22 with sidewall 24 and endwall 25 defining crankcase 26. Sidewall 24 defines an oil or fluid exit port 27 for discharge from crankcase 26. Endwall 25 defines a bore 54 to receive a first bearing assembly 56 and a seal means 58. Positioned in crankcase 26 and coaxial with longitudinal axis 52 is a drive shaft 42.

Figure 7:
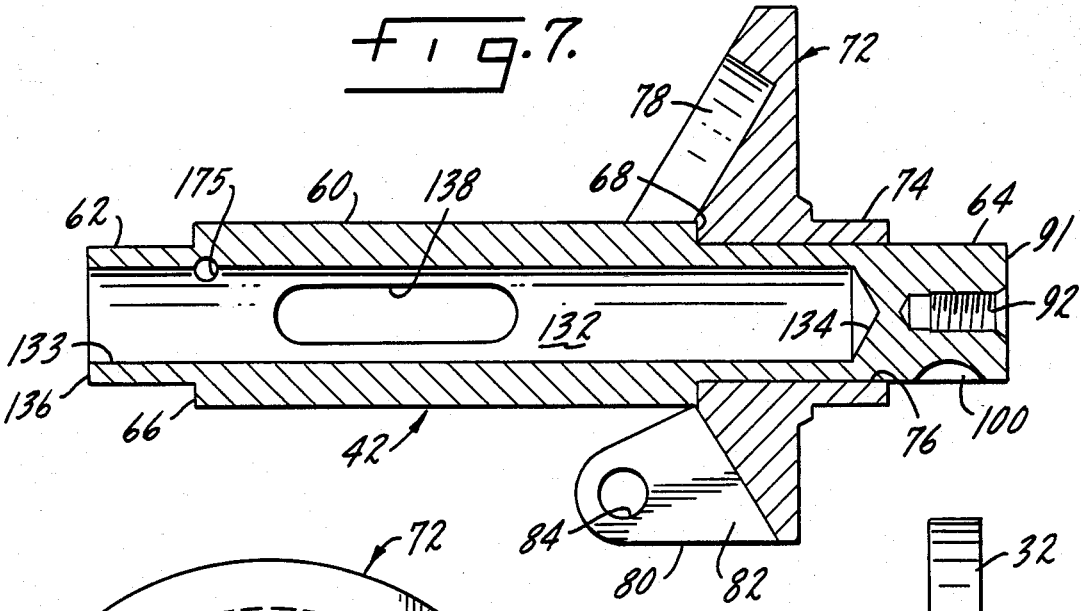
FIG. 7 is a cross-section view along the longitudinal axis of the drive shaft and thrust flange.

Drive shaft 42, shown in FIGS. 3 and 7, has a central portion 60 with a rectangular cross-section and defines first end segment 62, second end segment 64 with circular cross-sectional areas of a diameter no greater than the smallest dimension of the rectangular cross-section. Shoulders 66 and 68 of shaft 42 are defined by central portion 60 and circular cross-sectional ends 62 and 64, respectively. First end segment 62 has a second bearing assembly 70 mounted thereon. A thrust flange 72, illustrated in a front view in FIG. 8 and in a cross-sectional view in FIG. 7 on shaft 42, defines: a hub 74 with a bore 76 having a diameter similar to circular end 64 for mounting thereon; a recess surface 78; and at least one, but as shown, a pair of parallel extending flange members 80. Extending flange members 80 of thrust flange 72 define a slot 82 therebetween and have a cross-drilled hole 84 through members 80 and perpendicular to slot 82. Second end segment 64 of drive shaft 42 protrudes from crankcase 26 through bore 54. Thrust flange 72 is positioned on end segment 64 through hub 74 and abuts shoulder 68 of shaft 42. An external drive means 86 in FIG. 3 defines a mounting hub 88 with a first bore 87 and a second bore 89. Hub 88 is positioned on second end segment 64 of drive shaft 42 and retained thereon by a securing means 90 through second bore 89. Shaft 42 defines a second end face 91 and a longitudinal cavity 92 along axis 52 open at shaft end face 91 to receive securing means 90 extending through second bore 89 of drive means 86. Longitudinal cavity 92 is shown as a drilled and tapped hole to receive securing means 90 shown as a bolt with a bolt head 94 and extending through second bore 89 and threaded into tapped cavity 92. An annular washer 96 is mounted on securing means 90 between bolt head 94 and drive means 86. Hub 88 of drive means 86 contacts an inner race of bearing assembly 56 and the hub 74 of thrust flange 72. Hub 74 of thrust flange 72 is thus positioned between second end segment 64 of drive shaft 42 and first bearing assembly 56, and hub 88 of drive means 86 is positioned between seal means 58 and drive shaft second end segment 64. Shaft 42 defines a keyway slot 100 to receive a key 102 such as a Woodruff key shown in FIG. 3, to contact bore 87 of drive means 86 to secure it to shaft 42. Drive means 86 can be driven by an external power source, as known in the art, to provide rotational motion to drive shaft 42.

Cylinder block 28 is a means defining a plurality of fluid working spaces or compression cylinders 106, a front face 112 and a rear face 114, and a central cylinder 108 with rear face 109 and wall 110. Cylinders 106 and 108 are open at both faces 112 and 114. Front face 112 of cylinder block 28 abuts wall 24 of housing 22 to seal crankcase 26. Bearing assembly 70 is press fit into cylinder 108 at front face 112. Drive shaft first-end segment 62 is supported in bearing assembly 70 in central cylinder 108. Drive shaft 42 is, therefore, maintained in crankcase 26 coaxial with longitudinal axis 52 and rotatable in bearings 70 and 56 by drive means 86.

Figure 14:
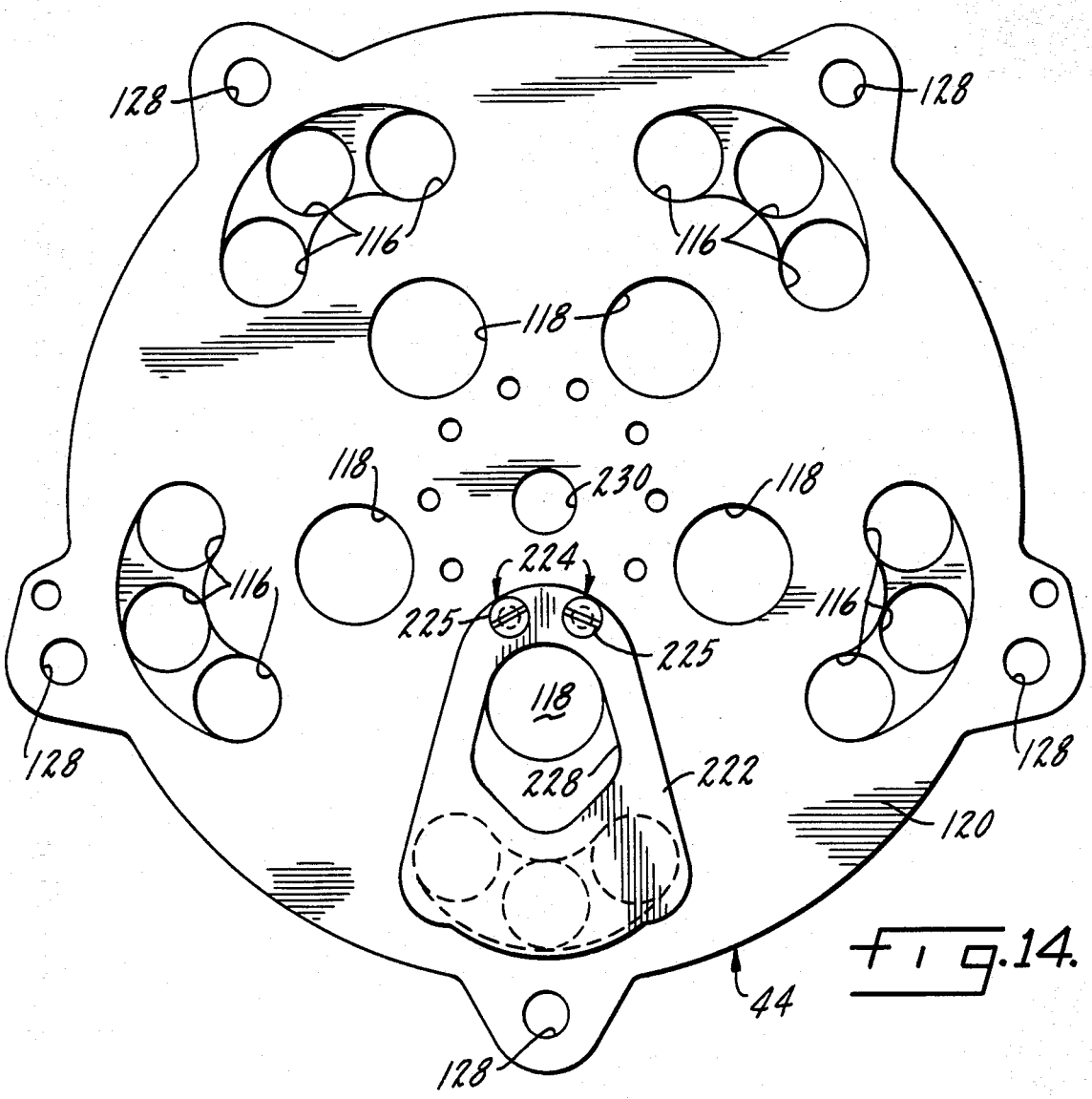
FIG. 14 is a plan view of valve plate assembly along the line 14—14 of FIG. 3 and includes an illustration of an inlet valve flap.
Figure 15:
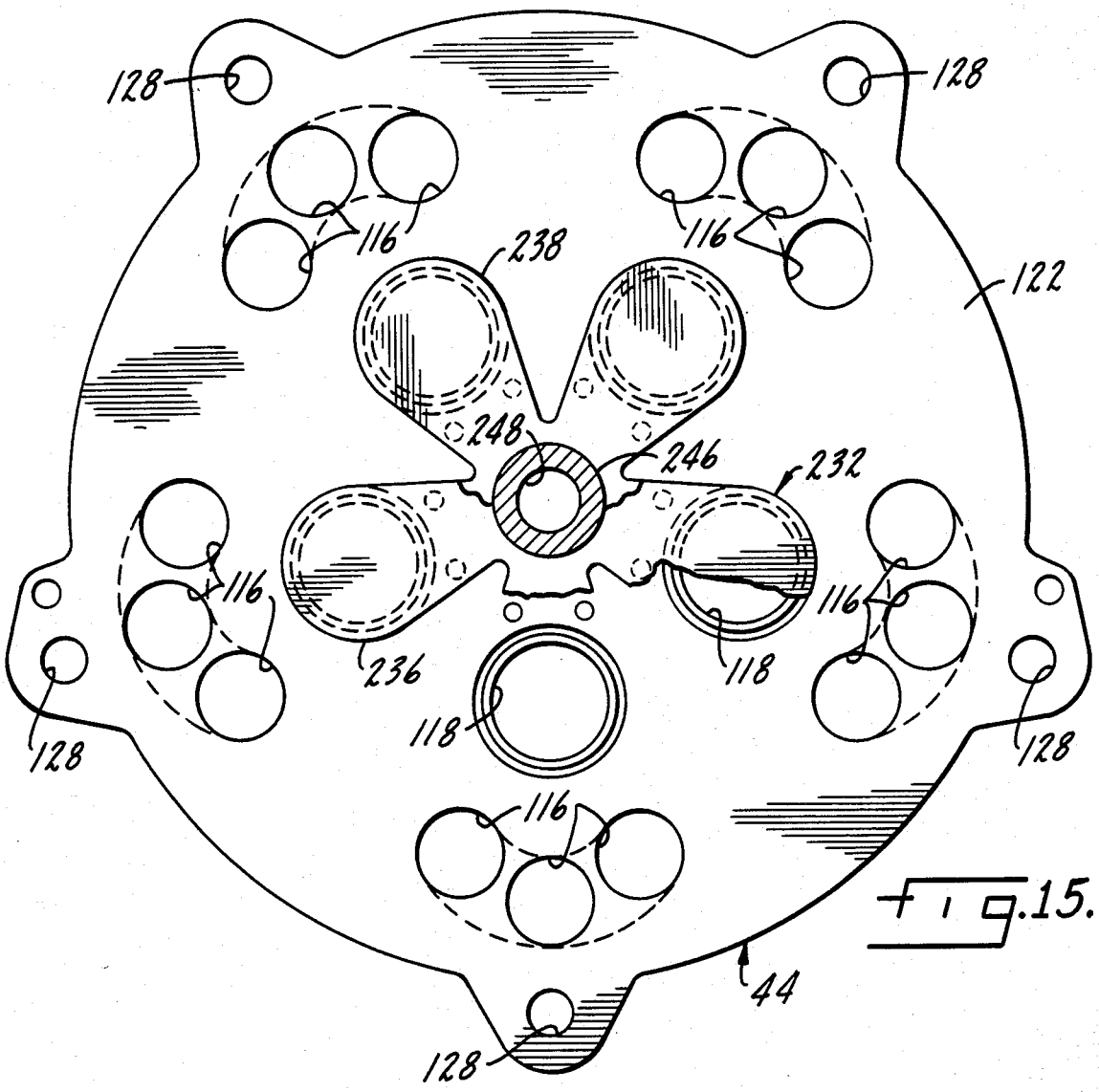
FIG. 15 is a plan view of the valve plate assembly taken along the line 15—15 of FIG. 3 and includes a cutaway section showing the exhaust valve flap and retainer.
Figure 16:
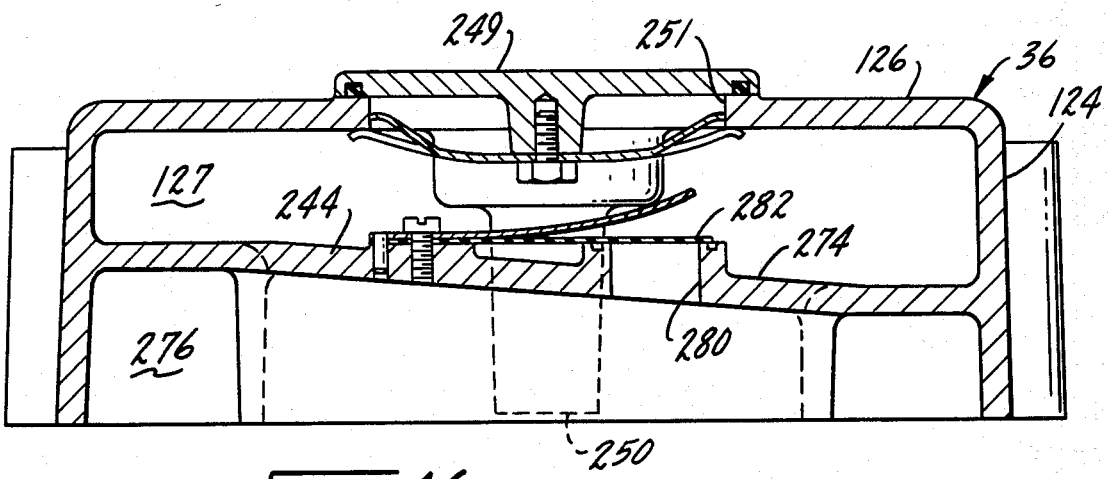
FIG. 16 is a sectional view of the head assembly taken along the line 16—16 of FIG. 11.

Valve assembly 44, defines a plurality of inlet ports 116, a plurality of discharge ports 118, a front face 120 and rear face 122 as shown in FIGS. 3, 14 and 15. Valve assembly 44 abuts cylinder block 28 with cylinder or fluid working spaces 106 which cooperate with at least one inlet port 116 and one discharge port 118 in each cylinder. Head assembly 36, illustrated in FIGS. 3, 11, 16, 17 and 18, includes sidewall 124, endwall 126, rib structure 244 and spiral surface 274 which cooperate to define a suction passage 276 and discharge cavity 127. A plurality of bores 128 are defined by head assembly 36, valve plate assembly 44, cylinder block 28 and housing 22 to receive a securing means 130, shown as threaded studs and nuts in FIG. 3, therethrough to maintain the subassemblies in assembled alignment and orientation. Gaskets or seal means, as known in the prior art but not individually noted, are provided between the mating faces of the subassemblies 36, 44, 28 and 22 to seal those surfaces from undesired seepage to both the exterior of s/c 20 and between these subassemblies.

Drive shaft 42, illustrated in cross-section in FIGS. 3 and 7, defines a longitudinal, blind-hole bore 132 with a sidewall 133 and a closed end 134, and an open end 136 at circular cross-section end 62. Drive shaft 42 also defines a cross-slot 138 through central portion 60 of drive shaft 42 with a longitudinal axis parallel to longitudinal axis 52.

Figure 9:
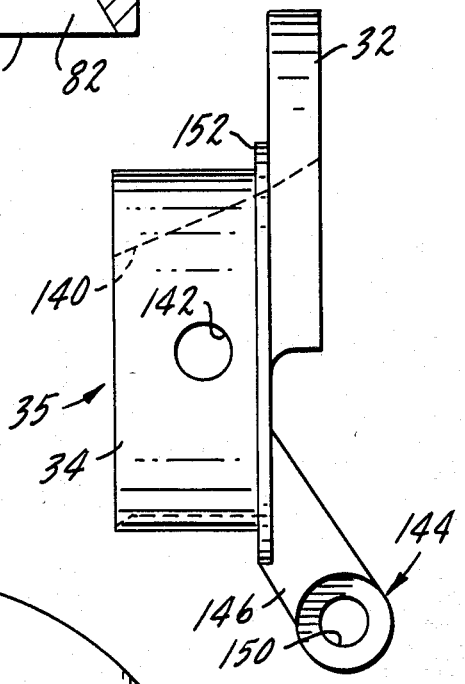
FIG. 9 is a side elevation view of the drive hub.
Figure 10:
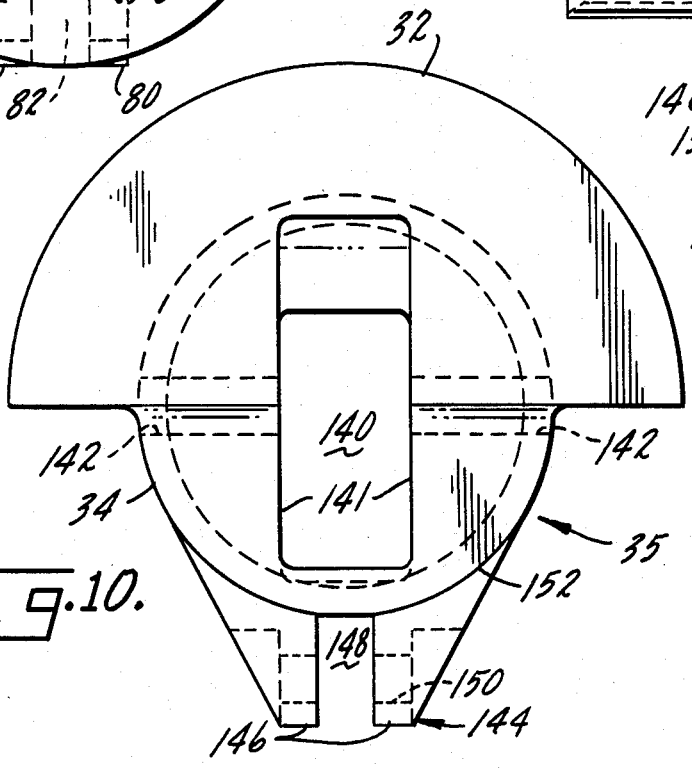
FIG. 10 is a front elevation view of the drive hub of FIG. 9.

As shown in FIG. 3, the drive hub and counterweight assembly 35 is mounted on drive shaft central portion 60 and slidable along drive shaft 42 within crankcase 26. FIGS. 9 and 10 illustrate drive assembly 35. In FIG. 10 hub 34 defines an oblong-shaped bore or central opening 140 with parallel sidewalls 141 through which bore drive shaft 42 extends. Hub 34 also defines a cross-hole 142 extending through the hub 34 perpendicular to longitudinal axis 52 of the s/c unit 20. Drive hub assembly 35 includes lug means 144 with parallel segments 146. Lug means 144 defines a slot 148 and a cross-drilled hole 150 through parallel segments 146 and perpendicular to slot 148. Lug means 144 is radially displaced from longitudinal axis 52, but maintains slot 148 in a direction parallel with the axis 52 and having an aligned, spatial relationship with slot 82 defined by extending flange members 80 of thrust flange 72. Drive hub assembly 35 includes a shoulder plate 152, which abuts a bearing assembly 198 as shown in FIG. 3.

Figure 8:
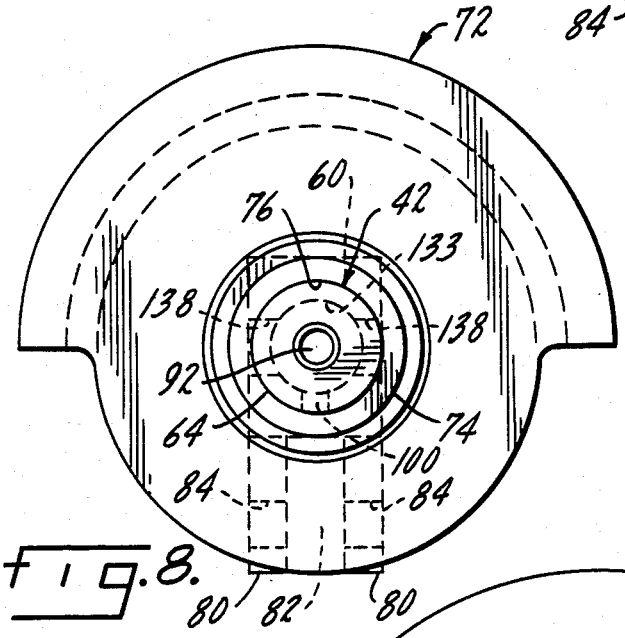
FIG. 8 is a front elevation view of the thrust flange of FIG. 7.

A pivotal link 154 having a first end 155 and a second end 157, shown in FIG. 3, defines link holes 156 and 158 at either end respectively thereof. Ends 155, 157 are positioned in slots 82 and 148 of thrust flange 72 and lug means 144, as shown in FIGS. 8 and 10 respectively.

Link hole 156 of link 154 is aligned with cross-drilled hole 84 of extending flange members 80 to receive a cross-pin 160 which allows pivotal movement to link 154. Similarly, link hole 158 is aligned with cross-hole 150 of lug means 144 to receive a cross-pin 162 to join these members. Link 154 can pivot about either cross-pin 160 or 162, however, thrust flange 72 and drive hub 34 are constrained to rotate together about axis 52. Link 154 provides a means to absorb the longitudinal thrust load from the drive hub 34 and wobble plate assembly 30 during the operating mode of s/c 20.

A first bias spring 164 is placed in bore 132 of drive shaft 42 against closed end 134, as shown in FIG. 3. Abutting spring 164 and slidable in bore 132 is a plug 166 defining a cross-drilled hole 168 in alignment or register with cross-slot 138 of drive shaft 42 and cross-hole 142 of hub 34 to receive a pin 170 thereby linking plug 166 and hub 34. The plug 166 and pin 170 linkage is constrained to a maximum longitudinal movement within bore 132 by the length of cross-slot 138, and thus the longitudinal travel of hub 34 is limited by the same slot length. Plug 166, which has two ends 181 and 183, defines a protuberance 172 at the end 181 contacting first bias spring 164 and a counterbore 174 at its opposite end facing open end 136 of drive shaft 42. A small centering bearing assembly 176 is positioned in counterbore 174.

Positioned in central cylinder 108 is an actuating piston 178 defining a stem 180 extending into bore 132 to contact plug 166 through bearing 176. Piston 178 further defines a piston head 182 with front face 184, a rear face 186 and an annular slot 188 to receive a seal means 190 which seals communication between piston 178 and wall 110. Actuating piston 178 defines a longitudinal blind-hole bore 179 open at piston rear face 186 and extending down the stem 180 to a closed end 189. A second bias spring 192, shown as a coil spring, is positioned in central cylinder 108 between cylinder rear face 109 and extends into blind hole bore 179 to abut closed end 189. Spring 192 has a smaller bias force than first spring 164 and operates to maintain contact between stem 180 and plug 166 through contact with bearing assembly 176. Piston head 182 defines a bleed orifice 194 through piston head 182, which provides minimal communication from front face 184 to rear face 186. Plug 166 and pin 170 cooperate to define a motion transfer means 173 communication between actuating piston 178 and hub mechanism 34.

Shaft 42 defines a cross-drilled passage 175 at sidewall 133, which hole is perpendicular to axis 52 and in proximity to shoulder 66. A rollpin 177 is placed through and secured in passage 175 to serve as a further limiting stop to the travel of plug 166 in bore 132. Rollpin 177 would appear as a chord in the circular cross-section of bore 132.

Cylinder block 28 defines a threaded through-hole passage 196 communicating along longitudinal axis 52 between rear face 114 and rear wall 109 of central cylinder 108.

Bias spring 164 provides a bias force tending to move plug 166 and hub 34 to a reference position in the inoperative mode of s/c unit 20. The reference position of drive hub 34 and wobble plate 30 is about perpendicular to longitudinal axis 52 and in proximity to cylinder block 28 along drive shaft 42 as shown in FIG. 1. The travel of plug 166 is limited to attainment of the reference position by rollpin 177.

Figure 5:
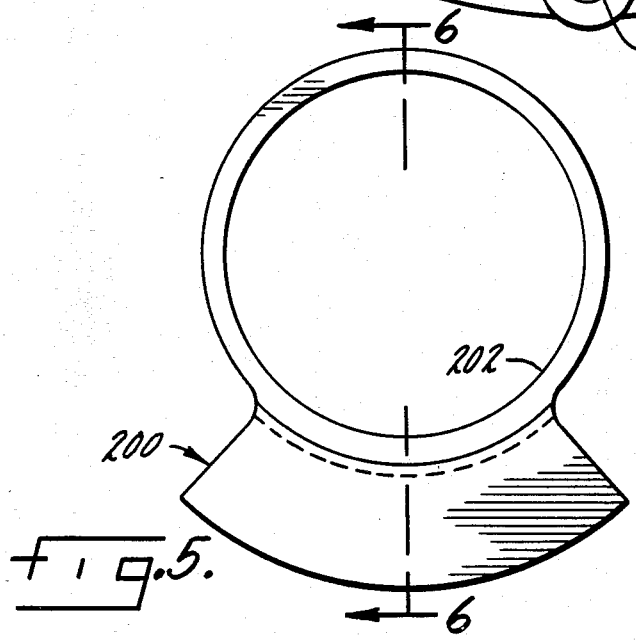
FIG. 5 illustrates the balance weight of the wobble plate assembly on end view.
Figure 6:
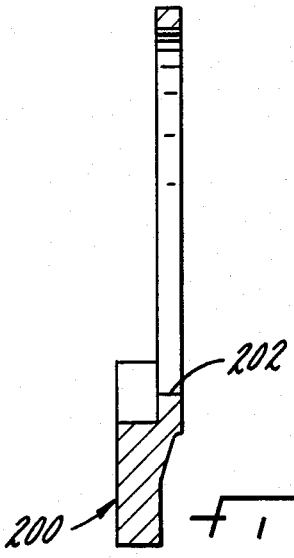
FIG. 6 is a cross-sectional view of the balance weight along a line 6—6 of FIG. 5.

In FIG. 3 a bearing assembly 198, illustrated as a ball bearing assembly, is positioned on drive hub 34 and contacts shoulder plate 152. Wobble plate 30 is positioned on bearing 198 without contacting either drive hub 34 or shoulder plate 152. Mounted about hub 34 and contacting bearing 198 is a balance weight 200, shown in FIGS. 3, 5 and 6 which balance weight 200 is staked at flange surface 202 defined by hub 34 to retain bearing 198 against shoulder plate 152. Balance weight 200 may be secured to hub 34 by any means known in the art such as screw threads, welding, brazing or staking. Wobble plate 30 is rotationally stationary, but drive hub 34 and counterweight 32 are rotatable with shaft 42 about axis 52. Wobble plate 30 mounted on bearing assembly 198 is connected to pistons 38 through connecting rods or means 40 by a ball and socket arrangement 204. Wobble plate 30 is driven in a nutating motion by rotating shaft 42.

Figure 4:
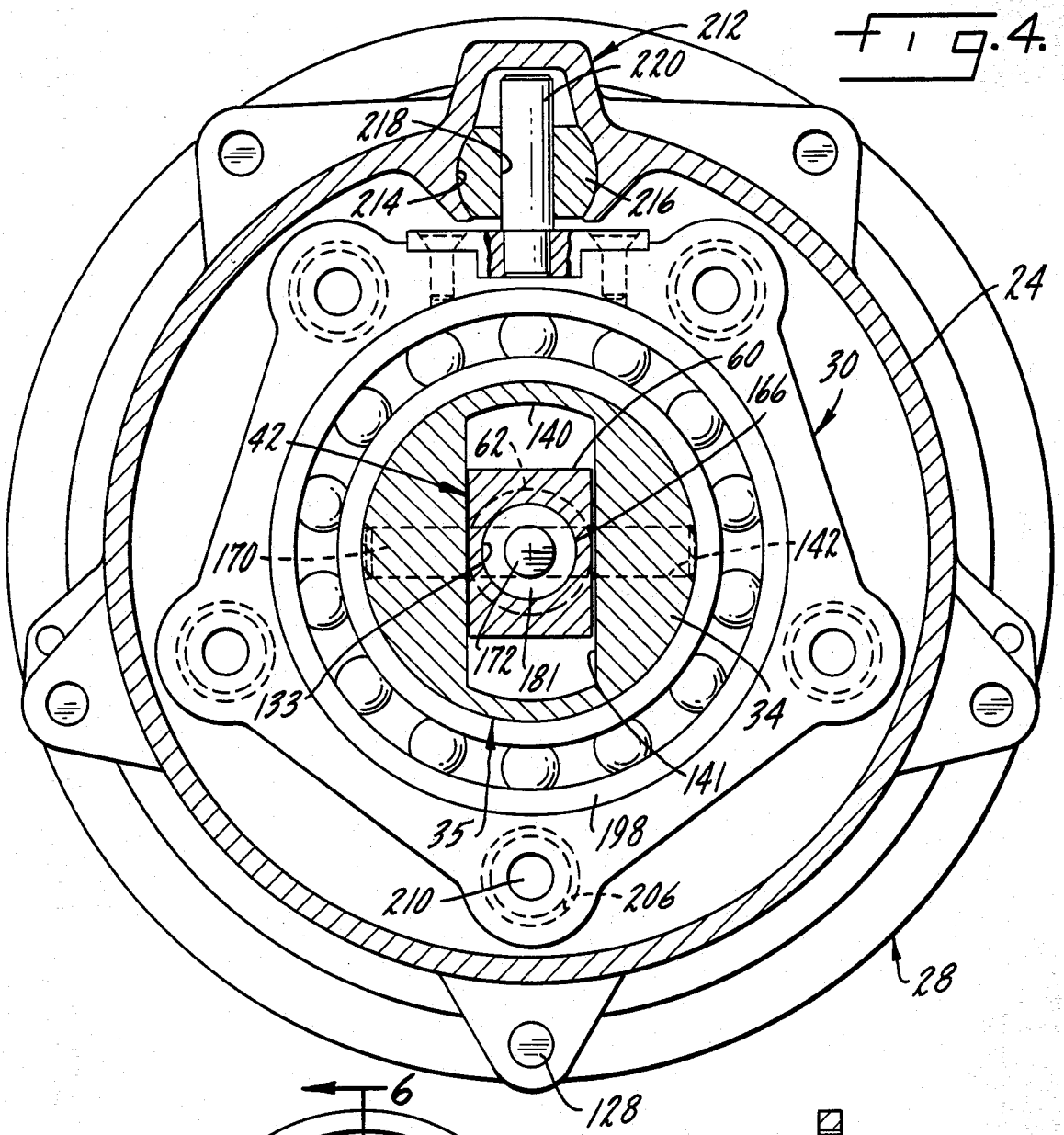
FIG. 4 is a cross-section view along the line 4—4 of FIG. 3 with the wobble plate assembly in the reference position.

Wobble plate 30, as illustrated in FIGS. 3 and 4, difines sockets 206 of ball and socket arrangement 204. A ball 208 in FIG. 3 of a connecting rod 40 is positioned in a ball joint liner 210 swaged over ball 208. This couplet of liner 210 and ball 208 is placed in socket 206 and securely staked therein. Wobble plate 30 is restricted from rotational motion by a ball and track restraint mechanism 212. As shown in FIG. 3 and in FIG. 4, mechanism 212 includes: a track 214 defined by housing 22; a ball 216, which defines a bore 218, is longitudinally slidable and pivotal in track 214; and, a pin 220 affixed to wobble plate 30, passing through bore 218 defined by ball 216 and slidable therein.

Valve ports 116 and 118 illustrated in FIGS. 14 and 15 have valve flaps positioned thereon. FIG. 14 is a front elevation view of valve plate assembly 44 and FIG. 15 is a cut-away rear view of the valve plate assembly 44 wherein the relationships of the valve flap assemblies valve retainer and valve ports 116 and 118 are illustrated. Each cylinder 106 is provided with a valve flap assembly and in FIG. 14 an inlet valve flap assembly 222 is positioned on valve plate assembly 44 front face 120 and secured thereto by rivets or screws 224. Cylinder block 28 in FIG. 3 defines counterbores 226 along rear face 114 to receive screw or rivet heads 225 of screws 224. Valve flap 222, shown as an inwardly tapered element defines an open port 228 in registry over discharge port 118. Each flap 222 covers inlet ports 116 of each fluid working space 106 in the s/c 20 reference position of FIG. 3, as well as during the compression stroke.

Valve plate assembly 44 defines a securing port 230. A discharge valve flap means 232 with a central through-hole 234 includes individual discharge finger flap valves 236 radially emanating from through-hole 234, which flaps 236 operate to cover the discharge ports 118. Discharge valve flap means 232 has a positive stop means assembly or valve retainer 238 secured atop each valve finger 236 to limit the travel of finger flap 236. A control through-hole 240 is defined by stop means 238 to receive a securing means 252.

Head assembly 36, shown in FIGS. 3, 11, 16, 17 and 18 with discharge cavity 127, defines an incoming gaseous charge (IGC) inlet port 242 and has a rib structure 244 therein. The IGC is provided by a charge forming apparatus 243 and communicated to the supercharger 20 by a conduit means 245 as shown in FIG. 2. Charge forming apparatus 243 is shown as a dotted box in an alternative position in FIG. 2. In this alternative position it is between the s/c 20, that is the s/c discharge 284 and the engine manifold or charge delivery means 288. In this alternative position a fuel charge is provided to the charge forming apparatus 243 at an elevated pressure for mixing with a pressurized aircharge, and an IGC is then communicated to engine 286 through charge delivery means 288. In FIG. 3 head assembly 36 defines a central bolt-hole hub 246 which hub 246 defines a through-bore 248 that is coaxial with axis 52 and valve plate assembly securing port 230. Hub 246 includes a front end 250 which contacts positive valve-stop means 238 and secures it against discharge valve flap means 232 and this alignment is secured against rear face 122 of valve assembly 44 by a hollow bolt 252, shown in FIGS. 12 and 13.

Cylinder block 28 defines a passage 196 communicating between central cylinder 108 and rear face 114 along axis 52. Passage 196 is in alignment with securing port 230 and through-bore 248. Passage 196 is threaded to receive mating threads 258 of a hollow bolt 252 to secure hub 246 against valve-stop means 238 and valve flap means 232 in this alignment.

As shown in FIGS. 12 and 13 hollow bolt 252 includes a central cylindrical body segment 256 having screw threads at securing end 258 and a smaller diameter cylindrical segment 260 extending from end 258 but coaxial with cylindrical segment 256. At the opposite end of cylindrical segment 256 is a hexagonal bolt head 262. A central longitudinal passage 264 and a cross-hole 266 perpendicular to longitudinal passage 264 at securing end 258 are defined by through-bolt 252. Bolt-head 262 defines a countersunk recess 268 coaxial with longitudinal passage 264 which recess 268 may be provided with threads to receive a connecting means, not shown but known in the art, to provide fluid communication through passage 264 and cross-hole 266.

Head assembly 36 defines a recess 270 which is cylindrical and coaxial with through-bore 248. Hollow bolt 252, as shown in FIG. 3, extends through bore 248, through-hole 240, securing port 230, and is threaded into the threads of passage 196. Smaller diameter segment 260 of bolt 252 extends into central cylinder 108 wherein second bias spring 192 (shown as a coil spring) is positioned about segment 260 and abuts a shoulder 272 defined at the junction of cylindrical segments 256 and 260 of bolt 252. Bolt 252 provides a fluid communication path between endwall 126 of head assembly 36 and central passage 108, and further, it secures head assembly 36, positive valve stop 238, discharge valve flap 232, valve plate 44 and cylinder block 28 along longitudinal axis 52.

Figure 17:
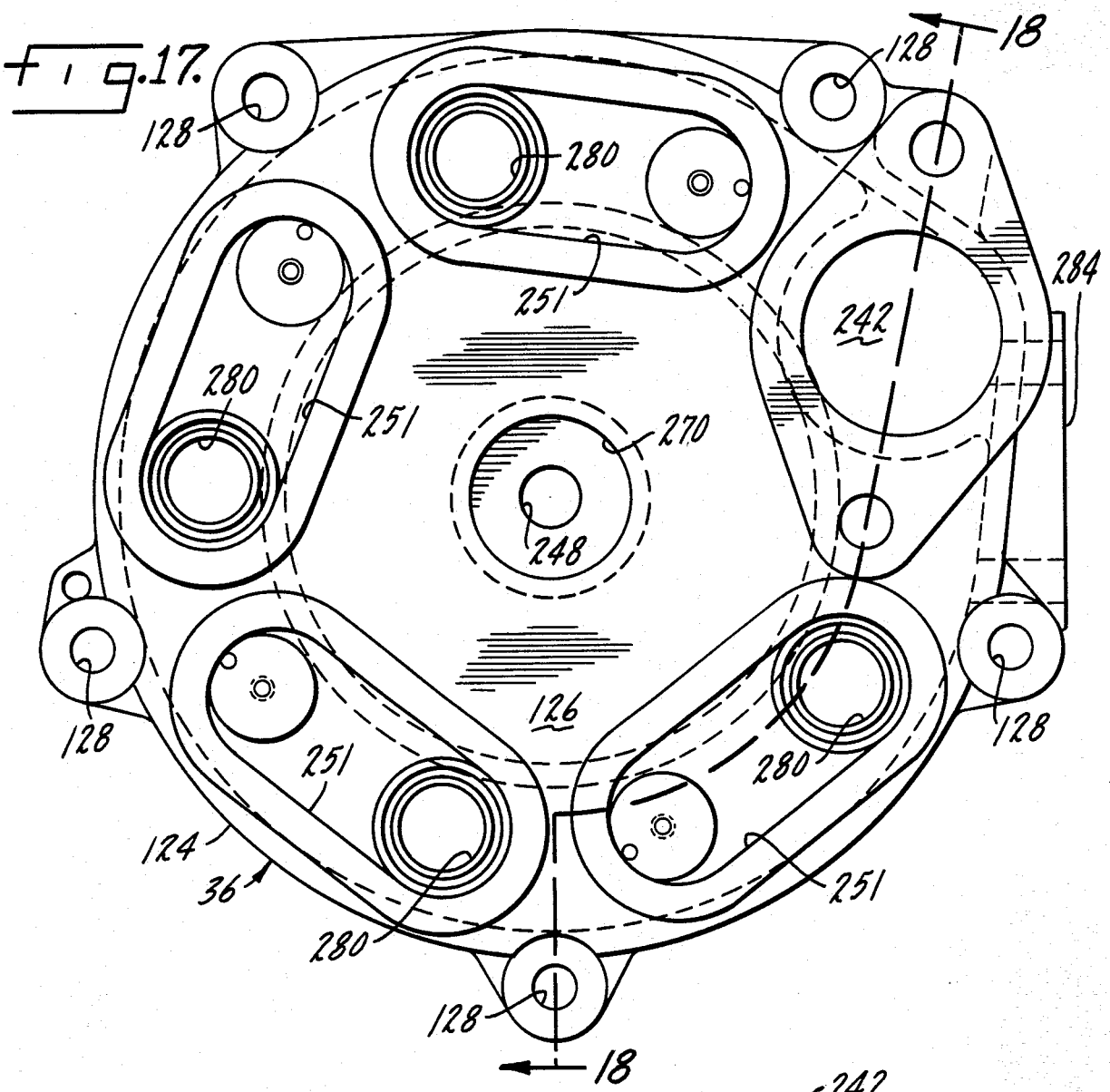
FIG. 17 is an end view of the head.
Figure 18:
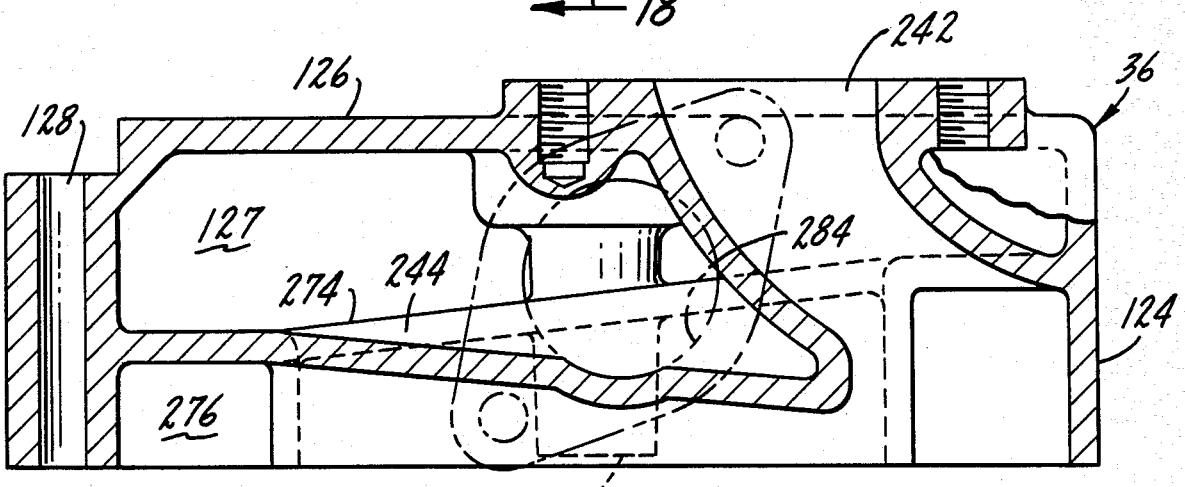
FIG. 18 is a sectional view of the head taken along line 18—18 and illustrates the exhaust channel therein.

Rib structure 244 defines a spiral surface 274 and a suction or inlet passage 276 communicating with inlet ports 116 to provide a path for an IGC through port 242 to pistons 38 in the operative mode of s/c 20. Discharge cavity or passage 127 communicates with discharge ports 118. Bypass ports 280, shown in FIGS. 11 and 17 in an end-view, are defined by rib 244. Ports 280 communicate between inlet passage 276 and discharge passage 127, where a bypass valve 282 in the discharge passage 127 is mounted over each port 280. Valves 282 are operable to permit direct flow between inlet and discharge passages 276 and 127 when the s/c 20 is inoperative and to seal communication therebetween in the operative mode. As shown in FIG. 17, head assembly 36 defines an s/c discharge port 284. Port 284 communicates discharge passage 127 to an engine 286, as illustrated in FIG. 2, through an engine-manifold, for example, or charge delivery means 288.

Figure 19:
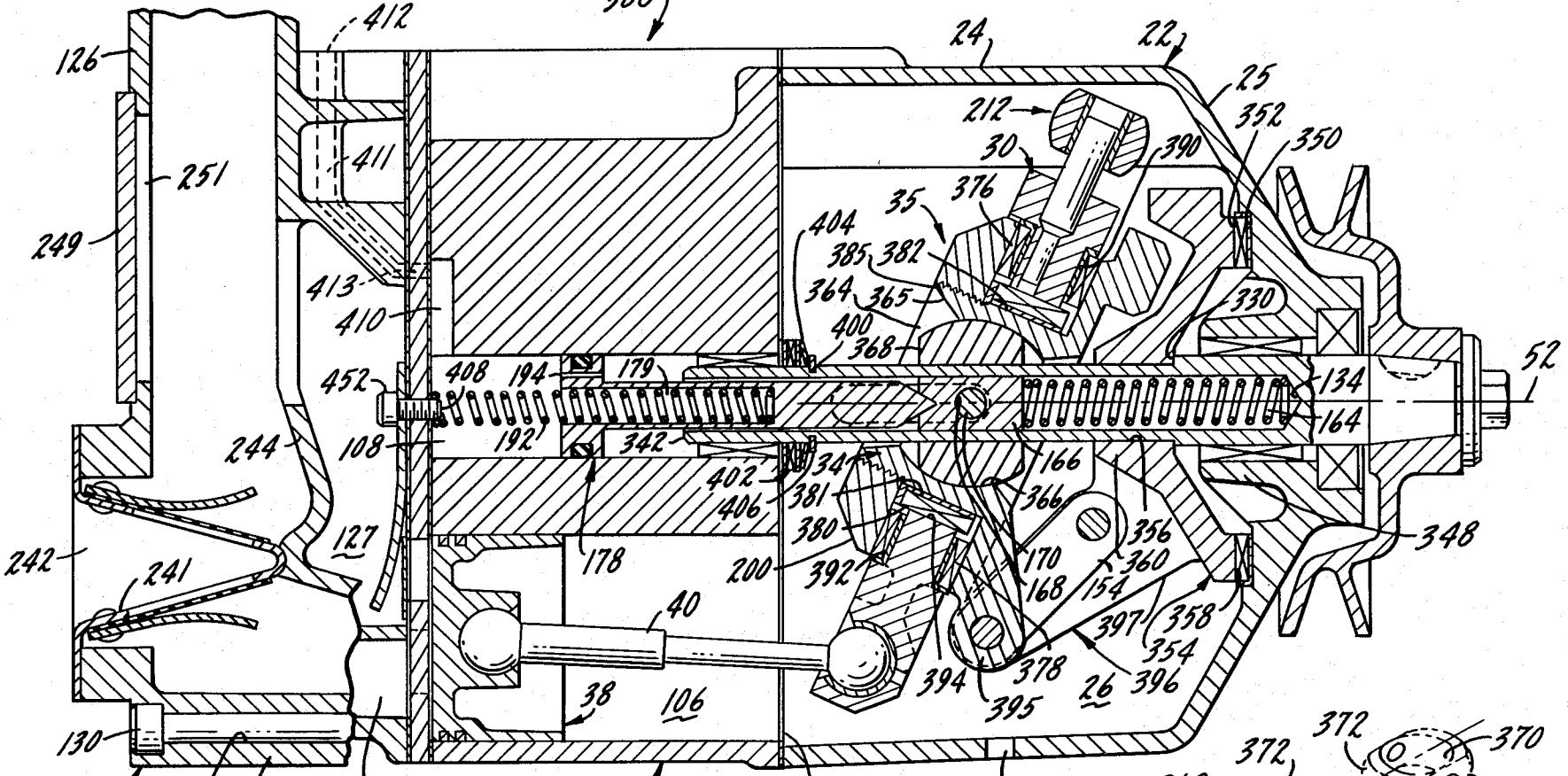
FIG. 19 illustrates a cross-sectional view along the longitudinal axis of an alternative embodiment.
Figure 20:
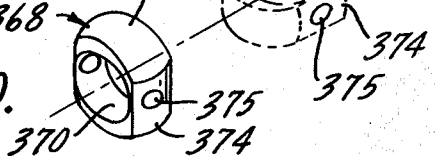
FIG. 20 illustrates the centering ball of FIG. 19.

In an alternative supercharger embodiment 300 as shown in FIG. 19 drive hub 34 is positionable on a centering ball 368 which is longitudinally slidable on a circular cross-section drive shaft 342 to provide nutating motion to wobble plate 30. In this embodiment like elements are similarly numbered as those in the preferred embodiment. In this embodiment hub 34 defines an axial hollow section 364 with an internal spherical surface 366 and a contact shoulder 365 to receive centering ball 368. Hub 34 is positionable and pivotable about centering ball 368. FIG. 20 shows centering ball 368 in cross-section and it defines: a bore 370 to slidably receive drive shaft 342; opposed spherical surfaces 372; opposed cylindrical surfaces 374 to allow its insertion into the hollow section 364 of hub 34; and, a through-hole 375 perpendicular to axis 52 across bore 370.

In FIG. 19 endwall 25 of housing 22 defines a rib 348 within crankcase 26 and an annular counterbored surface 350 to receive a needle thrust bearing assembly 352. A thrust flange 354, which defines a bore 356, a bearing surface 358 and bearing hub face 360, is mounted on shaft 342 through bore 356 in crankcase 26 to abut shoulder 330 defined by shaft 342. Needle bearing assembly 352 positioned in and against annular counterbored surface 350 is secured in that position by bearing surface 358 of thrust flange 354.

Wobble plate 30 in FIG. 19 defines front annular bearing surface 390, rear annular bearing surface 392 and radial bore bearing surface 394. Wobble plate 30 in FIG. 19 is mounted for relative movement with respect to the rotating drive hub 34 by means of three sets of bearings: a rear wobble plate thrust bearing 376; a front wobble plate bearing 378; and a radial wobble plate bearing 380 with inner race 381, which bearings contact bearing surfaces 390, 392 and 394, respectively. Inner race 381 of radial bearing 380 is mounted on the outer diameter 382 defined by hub 34, such that the drive hub 34 can rotate freely with respect to the wobble plate 30. To balance the assembly under dynamic conditions, a balance weight ring 200 is secured to a nose 385 defined by hub 34 which has screw threads thereon. Wobble plate 30 is again restrained against rotative movement by means of a restraint mechanism 212 as shown in FIG. 3 above. Drive hub and counterweight assembly 35 are rotatable about wobble plate 30 with drive shaft 342. Pin 170 as in the preferred embodiment of FIG. 3, is positioned through cross-hole 168 to contact centering ball 368 through-hole 375. Thereafter centering ball 368 is slidable along drive shaft 342 in cooperation with the longitudinal movement of centering plug 166.

In this alternative embodiment drive shaft 342 defines a notch 400 in proximity to cylinder block 28. A bearing cage assembly 402 is positioned on drive shaft 342 against cylinder block front face 112 with a Bellville washer 404 abutting said bearing assembly 402. The bearing 402 and washer 404 are retained in position by a snapring 406 or other means in notch 400. The longitudinal movement of centering ball 368 and thus drive hub 34 is restricted by the longitudinal travel of plug 166 as in the preferred embodiment. In this embodiment drive hub 34 and wobble plate 30 are pivotable about centering ball 368 and bearing surface 365 bears on shaft 42 in the operative mode.

Those skilled in the art will appreciate the use and operation of torque transmittal means 396 as shown in FIG. 19 herein, and also taught in U.S. Pat. No. 4,073,603. In this alternative embodiment the torque load is transmitted through extending flange ears 397, protruding from thrust flange 72 to define a slot 82 as in FIG. 7. In this embodiment drive assembly 35 defines a generally cylindrical lug means 395 with cross-drilled hole 150. At least two pivot links 154 are positioned within slot 82 and at least either end of lug means 395, to be secured by pins 160 and 162 through holes 84 and 150 as in FIGS. 3 and 7 through 10, respectively.

In alternative embodiment 300 a securing means 452 is shown as a bolt with a protuberance 408 extending into cavity 108. Second bias spring 192 is positioned about protuberance 408 and extends into bore 179 of piston 178 to maintain contact between plug 166 and piston 178.

Head assembly 36, shown in FIG. 19, illustrates IGC inlet port 242 having a valve means 241 mounted therein and communicating with IGC charge forming means 243 of FIG. 2 through a conduit 245. Head assembly 36, as shown in FIG. 19, cooperates with rib 244, sidewall 124 and endwall 126 to define the inlet or suction passage 276 and the discharge passage 127 wherein the IGC in the s/c inoperative mode is diverted through the discharge passage 127 by valve means 241, and in the operative mode is directed to the inlet passage for compression by pistons 38. In both structures illustrated herein, head assembly 36 is provided with a blow-off or safety cap means 249 over a large port 251 area defined by endwall 126 and communicating between atmosphere and the discharge passage 127. This cap means 249 is designed to open at a pressure above a designed operating pressure to protect the s/c against backfire as is known to occur with engines 286.

OPERATION

The operation of the invention will be discussed with particular reference to FIGS. 1, 2 and 3 wherein the operative mode of the invention can be most easily understood. In FIG. 1 the wobble plate 30 and drive hub 34 are shown in the reference position, that is wherein the drive hub 34 is perpendicular to the longitudinal axis 52 and in proximity to cylinder block 28. In this reference position compression pistons 38 do not reciprocate in cylinders 106 and inlet valve flaps 222 are retained against inlet ports 116 although drive hub 34 continues to rotate about axis 52 with drive shaft 42.

The drive shaft 42 is coupled to external drive means 86 which is driven by a power source, not shown. The drive transmitting means 86 is normally operated by direct drive means, but a clutch means may be utilized. In the reference position, as shown in FIG. 1, the load or drag on the power source will be minimal. However, in the reference position continued rotational motion of the drive hub 34 and thrust flange 72 will provide a means to agitate any lubricant in crankcase 26 to lubricate the bearings and mechanical assemblies therein.

The following discussion of the operation of the invention assumes continuous driving power and rotational motion being provided to drive means 86 and thus drive shaft 42. It will be assumed that such power is derived in cooperation with an automobile engine, such as engine 286 of FIG. 2. In addition, the incoming gaseous charge to the s/c 20 is an unthrottled charge, and all throttling (if any) is downstream of the s/c 20.

Operation of the s/c 20 in cooperation with an automobile engine is illustrated in FIG. 2. In FIG. 2 the s/c 20 is shown with control circuit 46. Control circuit 46 communicates with an accelerator switch 261, known in the art, of engine 286 through a conduit or conducting means 263.

When the engine 286 is operating in the cruise or idle modes, the s/c 20 is in the inoperative mode, that is where the wobble plate 30 and drive hub 34 are in the reference position. However, when the accelerator in the automobile is fully depressed, the accelerator switch 261 is actuated. Actuation of accelerator switch 261 provides a signal through conduit 263 to two-way valve 48 with an inlet and outlet side, which valve 48 is interposed between oil pump 50 of engine 286 and s/c 20. Oil or fluid under pressure from fluid pressure source or oil pump 50 is communicated through a conduit 265 to the inlet side of two-way valve 48 to a conduit 267 at the outlet side of valve 48 and thus to hollow bolt 252 of s/c 20. This oil (fluid) from pump 50 is at an operating pressure and if communication is open between oil pump 50 and bolt 252 fluid will be communicated through bolt passage 264 to central cylinder 108. In the alternative s/c embodiment 300 shown in FIG. 19, the fluid under pressure in cavity 108 is communicated through a passage 411 and port 412 defined by rib 244 and endwall 126 through a passage 413 defined by valve plate 44 to a passage 410 defined by cylinder block 28 at rear face 114.

As fluid at an operating pressure is introduced into cylinder 108, the pressure force acts on piston 178 to move piston 178 with stem 180, which is contacting plug 166 through bearing 176 in FIG. 3, against bias spring 164 in bore 132 of drive shaft 42. Piston 178, plug 166 and cross pin 170 move equidistant longitudinally along shaft 42. Similarly, hub 34 coupled to plug 166 by pin 170 also moves longitudinally on drive shaft 42 in crankcase 26. As pin 170 and the drive hub 34 are moved in a longitudinal direction along shaft 42 and further from cylinder block front face 112, the hub 34 and wobble plate 30 is pivoted about pin 170. The drive hub 34 and thrust flange 72 are joined by link 154 and pins 160, 162. The hub and wobble plate assembly thus pivots about pin 170 with the longitudinal movement of the hub and wobble plate such that when plug 166 with pin 170 has moved the maximum in slot 138 the drive hub 34 and wobble plate 30 are in their maximum stroke position, as shown in FIG. 3. All torque in the preferred embodiment is transmitted through the drive shaft 42 and hub 34 at the corners of the rectangular section 60 of drive shaft 42 which contacts the walls of oblong-shaped bore 140. Link 154 thus does not transfer torque to drive hub 34 but provides a means to absorb the longitudinal thrust to assembly 35. Thrust flange 72 and drive hub 34 are joined by link 154 and rotate in unison about longitudinal axis 52. In this operating mode as shown in FIG. 3 assembly 35, rotating about axis 52 on shaft 42, provides wobble plate 30 with a nutating motion on bearing assembly 198 about axis 52. Wobble plate 30 is further constrained from rotating motion by ball and track restraint mechanism 212 while drive hub 34 rotates within wobble plate 30.

As wobble plate 30 nutates about axis 52 compression pistons 38 reciprocate between a suction and discharge stroke in compression cylinders 106 as they are joined at ball and socket arrangement 204 of wobble plate 30 with connecting rods 40.

In this operating mode of FIG. 3 for an internal combustion engine 286, an IGC is drawn into inlet port 242, inlet passage 276 and thus through inlet ports 116 of valve plate assembly 44 past valve flap 222 into chambers 106 between compression piston 38 and front face 120 of valve plate assembly 44 on an inlet or suction stroke of pistons 38. As the wobble plate 30 and hub 34 continue to nutate through each rotation of shaft 42, the pistons will operate between a suction and compression stroke. As each piston 38 reaches its maximum intake or suction stroke, wobble plate 30 will provide force to start a compression stroke, that is, to drive said piston 38 in a direction toward valve plate assembly 44 in FIG. 3 to compress the IGC in cylinder 106. As the compression or discharge stroke of each piston commences, valve flap 222 is pressed against inlet ports 116 to thus seal further communication between the individual piston 38 commencing its compression stroke and the inlet passage 276. Thereafter piston 38 initiates compression of an entrapped IGC in said cylinder 106. As the IGC is compressed in cylinder 106 between piston 38 and valve plate assembly 44 the IGC is forced out of the piston through discharge ports 118 of valve plate assembly 44 thus forcing open valve flap finger 236 of the discharge valve flap means 232 to pass the compressed fluid to discharge passage 127. Discharge passage 127 communicates with discharge port 284 and provides an IGC to manifold 288 and thus engine 286. In the s/c 20 operating mode this IGC is at an elevated pressure, that is, for an internal combustion engine generally in the range of 6 to 8 psig and up to 15 psig for use in a diesel engine.

In the s/c 20 inoperative mode the IGC from charge forming apparatus 243 in FIG. 2 is introduced to the inlet or suction passage 276 through inlet IGC port 242 and is bypassed or communicated to discharge passage 127 and port 284 through bypass valve 282. Valves 282 are normally open valves in the inoperative mode as engine vacuum, that is pressure below atmosphere, lifts the valve 282 from port 280 communicating between inlet passage 276 and discharge passage 127 of s/c unit 20. Thereafter, the IGC, in the inoperative or reference mode of the s/c 20, is bypassed or directly passed from inlet passage 276 through port 280 to discharge passage 127 and thus to engine 286 in an uninterrupted flow to permit normal engine operation.

In the alternative embodiment illustrated in FIG. 2 charge forming apparatus 243 is positioned between s/c 20 and engine 286 as indicated by the dotted block of FIG. 2. In this embodiment fuel at an elevated pressure is communicated to charge forming apparatus 243 for combination with air at an elevated pressure, and this mixture is subsequently communicated to engine 286 through charge delivery means 288. Thus the s/c 20 is operable with a charge forming apparatus 243 either providing an IGC to s/c 20 or receiving an IGC charge from s/c 20. The position of charge former 243 is dependent upon the design and operation of the fuel delivery and engine system provided.

Thus it can be seen s/c 20 is operative only during that period when accelerator switch 261 is actuated to thereby actuate or open two-way valve 48 for the introuction of operating fluid under pressure to the actuating piston in cylinder 106. This actuation is operable within one-half second or less.

Similarly, in the alternative embodiment of FIG. 19 actuating piston 178 operates to move plug 166 and thus centering ball 368 longitudinally on drive shaft 342 along axis 52 to move wobble plate 30 and drive hub 34 into the operating mode. In that operating mode wobble plate 30 nutates as hub 34 rotates. The angular load is transmitted or borne at bearing surface 365 which contacts drive shaft 342 to provide a bearing load, and torsional drive is provided by torque transmittal means 396.

When the accelerator switch 261 is disengaged, that is when the accelerator is no longer depressed in the case of an automobile engine, two-way valve 48 is again sealed against communication of pressurized fluid from oil pump 50 to actuating piston 178 and bias spring 164 operates to move plug 166 and thus wobble plate 30 with drive hub 34 to the reference position such that further compression of the IGC is stopped. In that reference mode drive hub 34 and wobble plate 30 are again perpendicular to axis 52 and in proximity to cylinder block 28. As disclosed herein the s/c 20 is operable between the reference or inoperative mode and the operative mode which is the maximum displacement of plug 166 and pin 170 along slot 138.

Oil from crankcase 26 is returned to the oil pump which may or may not have a sump, through an oil port 27 defined by sidewall 24 and a conduit 269, as in FIG. 2.

Two-way valve 48 in FIG. 2 is provided with a bleed orifice 273, shown as a dashed line, which permits a minimal flow therethrough and introduces a continuous fluid flow to central cylinder 108. This fluid is communicated past piston head 182 through bleed orifice 194 and thus provides a fluid to lubricate bearings and moving parts within the crankcase assembly.

As disclosed herein this s/c unit 20 is operable between the reference position and maximum stroke. The invention has been described in connection with certain specific embodiments thereof, it is understood that this is by way of illustration and not by way of limitation. The scope of the appended claims should be construed as broadly as the prior art permits.

I claim:

1. A controlled displacement supercharger having a longitudinal axis, and comprising:

a valve plate assembly defining a plurality of inlet ports and discharge ports;

a first means defining a central cylinder with a wall, and a plurality of fluid working spaces;

said valve plate coupled to said first means such that each fluid working space cooperates with at least one inlet port and one discharge port;

a piston in each working space for movement to compress a fluid therein;

an actuating piston slidably positioned in said central cylinder, and operable by a fluid pressure;

a rotating drive shaft having a rectangular cross-section and an axis coincident with the longitudinal axis of said supercharger;

a drive hub and counterweight assembly mounted on said drive shaft, said drive hub having a reference position perpendicular to the longitudinal axis of said drive shaft and said hub defining an oblong central opening;

means providing communication from said actuating piston to said drive hub mechanism to provide sliding motion thereto;

a wobble plate mounted around said hub; and means operably connected between said wobble plate and the pistons;

said means for communication from said actuating piston to move said wobble plate and hub mechanism along said drive shaft includes; said drive shaft defining a first and second end segment, said second end segment positioned in a first bearing assembly, a blind-hole bore open at said drive shaft first end segment and having a closed end; and, said drive shaft defining a cross-slot;

a second bearing assembly mounted in the end of said central cylinder opposite said valve plate assembly to receive said drive shaft first end segment;

a first bias spring positioned in said blind-hole bore against said closed end;

a plug slidable in said bore, abutting said first bias spring and defining a cross-hole therethrough alignable with said cross-slot;

said hub mechanism defines a through-hole alignable with the drive shaft cross-slot and the plug cross-hole to couple these members by a pin for movement in unison;

said actuating piston defines a stem to contact and move said plug and a piston head which head includes a seal means contacting the wall defined by the central cylinder;

a second bias spring positioned in said central cylinder and contacting said actuating piston and a securing means segment or valve plate and operable to maintain said piston stem in contact with said plug;

a thrust flange defining at least one extending flange member;

a pivot link with a first end and a second end and having said first end attached to said extending flange member and said second end attached to said drive hub at a position spaced from the axis of the drive shaft so that said drive hub mechanism is pivoted at a point not coincident with said drive shaft axis;

said actuating piston moves said drive hub mechanism longitudinally on said drive shaft to a second position which forms an acute angle relative to said reference position, which drive shaft at its rectangular cross-section corners delivers all the torque to drive said drive hub and thus drives said wobble plate in a nutating motion about said drive shaft axis.

2. A controlled displacement supercharger as claimed in claim 1 wherein said first bias spring is operable against said plug to maintain said wobble plate and hub mechanism in said reference position.

3. A controlled displacement supercharger as claimed in claim 1 wherein said actuating piston head defines a bleed orifice to communicate lubricating fluid therethrough.

4. A controlled displacement supercharger as claimed in claim 1 wherein said wobble plate and hub are movable along said drive shaft between said reference position and a maximum displacement defined by said cross-slot.

5. A control circuit for a controlled displacement supercharger as claimed in claim 1 which circuit comprises:

a fluid pressure means:

a two-way valve having an inlet and outlet side and being responsive to an external signal, and a bleed orifice to pass a continuous flow of lubricating fluid to said central cylinder;

and conduit means connecting said two way valve to said fluid pressure means and said central cylinder to provide fluid operating pressure to said actuating piston.

6. A control circuit for a controlled displacement supercharger as claimed in claim 5 wherein said external signal is provided by an accelerator switch.

7. A control circuit as claimed in claim 5 wherein said incoming gaseous charge from said charge forming apparatus continuously communicates to said engine through said head assembly.

8. A controlled displacement supercharger having a longitudinal axis, and comprising:

a valve plate assembly defining a plurality of inlet ports and discharge ports;

a first means defining a central cylinder with a wall, and a plurality of fluid working spaces;

said valve plate coupled to said first means such that each fluid working space cooperates with at least one inlet port and one discharge port;

a piston in each working space for movement to compress a fluid therein;

an actuating piston slidably positioned in said central cylinder, and operable by a fluid pressure;

a rotating drive shaft having a rectangular cross-section and an axis coincident with the longitudinal axis of said supercharger;

a drive hub and counterweight assembly mounted on said drive shaft, said drive hub having a reference position perpendicular to the longitudinal axis of said drive shaft and said hub defining an oblong central opening;

means providing communication from said actuating piston to said drive hub mechanism to provide sliding motion thereto;

a wobble plate mounted around said hub; and means operably connected between said wobble plate and the pistons;

a thrust flange defining at least one extending flange member;

a pivot link with a first end and a second end and having said first end attached to said extending flange member and said second end attached to said drive hub at a position spaced from the axis of the drive shaft so that said drive hub mechanism is pivoted at a point not coincident with said drive shaft axis;

said actuating piston moves said drive hub mechanism longitudinally on said drive shaft to a second position which forms an acute angle relative to said reference position, which drive shaft at its rectangular cross-section corners deliver all the torque to drive said drive hub and thus drives said wobble plate in a nutating motion about said drive shaft axis; and a head assembly wherein a plurality of bypass valves positioned in said head assembly provide a means to direct the flow of the incoming gaseous charge in the s/c inoperative mode.

9. A supercharger having a longitudinal axis and comprising:

a valve plate assembly means defining a plurality of inlet ports and discharge ports;

a first means defining a plurality of fluid working spaces, each cooperating with at least one inlet and discharge port, and a piston in each space for movement to compress a fluid therein, a central cylinder, and positioned in the central cylinder an actuating piston slidably operable by a fluid pressure;

a drive shaft positioned along the longitudinal axis having a first end segment and a second end segment, and defining: a circular cross-sectional area at each end of said shaft, a rectangular cross-sectional area along a central portion of said shaft, a blind-hole bore open at said first end of said shaft which end is positioned in said central cylinder, and, along the rectangular cross-sectional area, a cross-slot through said shaft and bore, said blind-hole bore including a closed end and a first bias spring positioned against said closed end;

a drive assembly, including a hub having a cross-hole, which hub defines a central elongated bore with parallel sidewalls, which drive assembly is slidable along and driven by said rectangular section of said drive shaft;

a wobble plate for nutational drive by said drive assembly about the drive shaft axis;

means operably connected between said wobble plate and the individual pistons to impart reciprocating drive to said pistons, the length of stroke being a function of the angle at which said wobble plate is supported relative to said drive axis;

a thrust flange mounted on said drive shaft to receive the longitudinal thrust load and including at least one axial extending flange member;

associated with said drive assembly is a lug means in spaced, aligned relation with a surface on said extending flange member;

a pivot link having a first and second end which first end is attached to said exending flange member and said second end attached to said lug means, said lug means being spaced from the axis of said drive shaft so that said drive assembly is pivoted at a point not coincident with said drive shaft axis;

a plug slidable in said blind-hole bore of said drive shaft and contacting said first bias spring, which plug defines a cross-hole alignable with said cross-slot and said cross-hole of the hub;

a pin extending through said plug, said cross-hole of said hub and said cross-slot of said drive shaft, to couple longitudinal axial movement of said drive assembly and the wobble plate, with the actuating piston contacting the plug in the blind-hole bore to propel the pin and the coupled drive assembly along said cross-slot into the operating mode and where said hub has torque communicated to it by contact betwen the rectangular corners of said drive shaft and said central bore sidewalls without producing a bending moment on said link or said pin; and where said angle of the wobble plate-drive assembly is maintained through said link, and where said link maintains such angular position against the longitudinal thrust load from said wobble plate-drive assembly.

10. A controlled displacement supercharger having a longitudinal axis, and comprising:

a valve plate assembly defining a plurality of inlet and discharge ports;

a first means defining a central cylinder and a plurality of fluid working spaces;

said valve plate coupled to said first means such that each fluid working space cooperates with at least one inlet port and one discharge port;

a piston in each fluid working space for movement to compress a fluid therein;

an actuating piston having a stem and a piston head, which piston is slidably positioned in said central cylinder and defines a longitudinal blind hole with a closed end and an open end open at said piston head, and is operable by a fluid pressure;

a rotating drive shaft having an axis coincident with the longitudinal axis of said supercharger and defining a first end, a second end, a cross-slot through said drive shaft, and a longitudinal blind-hole bore having a closed end at said second end and is open at said first end, which first end is positioned in said central cylinder;

a wobble plate and hub assembly mounted on said drive shaft, said wobble plate and hub assembly having a reference position almost perpendicular to the longitudinal axis of said drive shaft and said wobble plate and hub assembly including a centering ball with a central bore slidably mounted on said drive shaft, and having a hub of said wobble plate and hub assembly defining an inner spherical surface mounted on said centering ball;

means providing communication from said actuating piston to said wobble plate and hub assembly and centering ball to provide sliding motion thereto which means includes a pin and plug where said pin is longitudinally movable in said drive shaft cross-slot;

a wobble plate mounted around said hub; and means operably connected between said wobble plate and said pistons;

a first bias spring positioned against said closed end of said blind-hole of said drive shaft;

an engaging plug having a longitudinal axis, a spring-containing end and a stem-containing end coaxial with said drive shaft axis, which plug defines a through-hole transverse to said plug axis, said plug being positioned in said drive shaft blind-hole to abut said first bias spring at said spring-contacting end and to contact the actuating piston stem at said stem-containing end;

a second bias spring of a force substantially smaller than the force of said first bias spring, positioned in said actuating piston blind-hole to contact said closed end thereof and extending therefrom to abut said valve plate assembly to maintain contact between said actuating piston and said engaging plug;

said wobble plate including a centering ball defining a through-hole, which centering ball is positioned on and slidable along said drive shaft;

a locking pin extending through said through-holes of the centering ball and engaging plug, and through said cross slot of the drive shaft, to thereby constrain the travel of said wobble plate with said plug and centering ball;

said first bias spring biasing said engaging plug and thus said wobble plate to a reference or inoperative position, a head assembly defining input and output means and passages for an incoming gaseous charge, which passages communicate with said fluid working spaces through said valve plate, and also defining an oil or fluid port and passage which communicates between a fluid supply means for supplying fluid under pressure and said actuating cylinder which fluid pressure provides a force to move said actuating piston against said first bias spring and thereby to move said wobble plate and hub assembly to a maximum displacement position and into a supercharging mode from its reference position.

11. A supercharger assembly as claimed in claim 10 wherein said actuating piston defines a lubricating bleed orifice communicating between said actuating piston and said crankcase to provide lubricating fluid to said wobble plate assembly.

12. A controlled displacement supercharger as claimed in claim 10 in combination with an engine having a charge forming apparatus providing an incoming gaseous charge (IGC) and an engine manifold or charge delivery means wherein said supercharger is interposed between said charge forming apparatus and said charge delivery means to elevate, in the s/c operating mode, the incoming gaseous charge pressure above normal operating pressures.

13. A controlled displacement supercharger as claimed in claim 10 in combination with an engine having a charge forming apparatus and a charge delivery means wherein said charge forming apparatus is interposed between said engine and said supercharger to receive an incoming gaseous charge at an elevated pressure from said s/c for communication to said engine or charge delivery means.

14. A controlled displacement supercharger as claimed in claim 13 wherein said supercharger is operable to elevate the incoming gaseous charge to a pressure up to fifteen pounds per square inch gage (15 psig).

* * * * *

UNITED STATES PATENT AND TRADEMARK OFFICE

CERTIFICATE OF CORRECTION

PATENT NO. : 4,506,648

DATED : March 26, 1985

INVENTOR(S) : RICHARD W. ROBERTS

It is certified that error appears in the above—identified patent and that said Letters Patent is hereby corrected as shown below:

Column 14, line 43, cancel "deliver" and insert -- delivers --.

Column 15, line 41, cancel "betwen" and insert -- between --.

Column 16, line 26, cancel "containing" (first occurrence and insert -- contacting --.

Column 16, line 26, cancel "stem-containing" and insert -- stem-contacting --.

Column 16, line 32, cancel "stem-containing" and insert -- stem-contacting --.

Signed and Sealed this

*Twenty-third* Day of *July 1985*

[SEAL]

*Attest:*

DONALD J. QUIGG

*Attesting Officer* *Acting Commissioner of Patents and Trademarks*